US005570587A

United States Patent [19]

Kim

[11] Patent Number: 5,570,587

[45] Date of Patent: Nov. 5, 1996

[54] REFRIGERATOR WITH STORAGE COMPARTMENTS AND DISPENSING MEANS

[75] Inventor: Kyeong-Taek Kim, Seoul, Rep. of Korea

[73] Assignee: Goldstar Co., Ltd, Seoul, Rep. of Korea

[21] Appl. No.: 336,100

[22] Filed: Nov. 4, 1994

[30] Foreign Application Priority Data

Nov. 6, 1993 [KR] Rep. of Korea ..... 1993-23484

[51] Int. Cl.[6] ..... F25D 15/00; F25D 23/12; G07F 11/72

[52] U.S. Cl. ..... 62/331; 62/285; 221/97; 221/150 R

[58] Field of Search ..... 62/285–290, 272, 62/274, 441, 91, 92, 331; 221/97–98, 150 R; 222/130–146.1, 146.6

[56] References Cited

U.S. PATENT DOCUMENTS

| | | | |
|---|---|---|---|
| 1,628,083 | 5/1927 | Vogt | 62/441 |
| 2,089,960 | 8/1937 | Hull et al. | 62/91 |
| 2,893,805 | 7/1959 | Ferguson | 62/441 |
| 3,696,632 | 10/1972 | Carlin et al. | 62/285 |
| 4,751,826 | 6/1988 | Kawahara et al. | 62/382 |
| 5,388,427 | 2/1995 | Lee | 62/331 |
| 5,411,328 | 5/1995 | You | 312/405 |

FOREIGN PATENT DOCUMENTS

| | | | |
|---|---|---|---|
| 1219468 | 9/1989 | Japan | 62/441 |
| 1083 | 1/1991 | Japan | 62/441 |
| 1482926 | 8/1977 | United Kingdom | 62/441 |

*Primary Examiner*—William Doerrler
*Attorney, Agent, or Firm*—Spencer & Frank

[57] ABSTRACT

This invention relates to a multifunction refrigerator for transmitting cool air into a cereal storage room and kimchi storage room, comprising an evaporator 700 for generating cool air from a wall face of the refrigerator and a first partition 400 for conducting the cool air generated from said evaporator 700 into a cold storage room 100 and cereal storage room 200, and dividing the refrigerator into two parts of the cold storage room 100 and the cereals custody room 200. And, this refrigerator also comprises an evaporator 700 for generating cool air from a wall face of a refrigerator and a second partition 500 for transmitting compulsorily cool air generated from the evaporator 700 and thereby maintaining kimchi storage room 300 at low temperature, and inhalation fan for inhaling cool air.

9 Claims, 6 Drawing Sheets

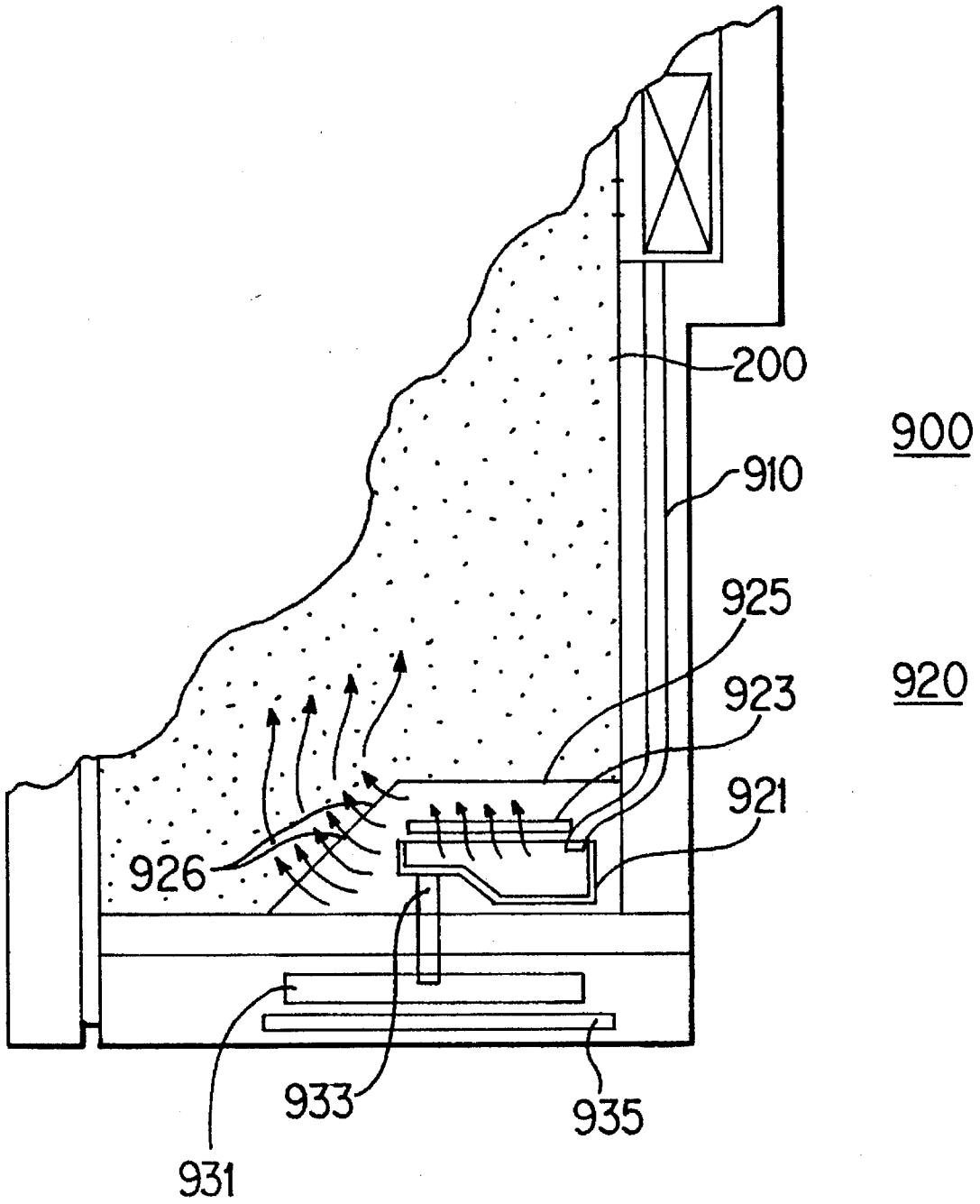
930 FIG. 9

REFRIGERATOR WITH STORAGE COMPARTMENTS AND DISPENSING MEANS

FIELD OF THE INVENTION

This invention relates to a refrigerator, more particularly to a refrigerator having cereals and/or kimchi storage function and making it possible to transmit cool air to the inside of cereals and kimchi storage locations.

BACKGROUND OF THE INVENTION

FIG. 1 shows a conventional multifunction rice barrel. The multifunction rice barrel comprises a window 2 for seeing the amount of a remaining rice in rice barrel 1, a withdrawal box 4 withdrawing rice in rice barrel for a multistage storage room 5 for storing various kinds of foods and an door 6 for the multistage storage room 5.

This conventional multifunction rice barrel can store rice and other various kinds of foods. However, since the temperature in the rice barrel 1 is not constant, there is a problem that rice and other foods, can degenerate.

Further, since this conventional rice barrel needs a special kimchi barrel or earthenware for storing kimchi and user should purchase and store much goods separately, storage is extravagant, difficult for a long term and requires a wide space.

SUMMARY OF THE INVENTION

Accordingly, the object of the present invention is to provide a multifunction refrigerator needing a small space for establishing and including kimchi storage room, cereals storage room and cold storage room.

Other object of the present invention is to provide a multifunction refrigerator for storing kimchi for a long term.

Further object of the present invention is to provide a multifunction refrigerator for storing cereals such as rice etc. for a long term.

To accomplish these objects, the multifunction refrigerator according to the present invention comprises an evaporator for generating cool air from a wall face of a refrigerator and a first partition for conducting the cool air generated from said evaporator into a cold-storage room and a cereal storage room, and dividing the refrigerator into two parts of the cold-storage room and the cereals storage room. And, this refrigerator may comprise an evaporator for generating cool air from a wall face of a refrigerator and a second partition for transmitting cool air generated from said evaporator and thereby maintaining kimchi storage room at low temperature, and inhalation fan for inhaling cool air.

BRIEF DESCRIPTION OF THE DRAWINGS

FIG. 9 is a partially sectional view showing a humidity control part in accordance with the present invention.

DETAILED DESCRIPTION OF THE INVENTION

Figure 1:
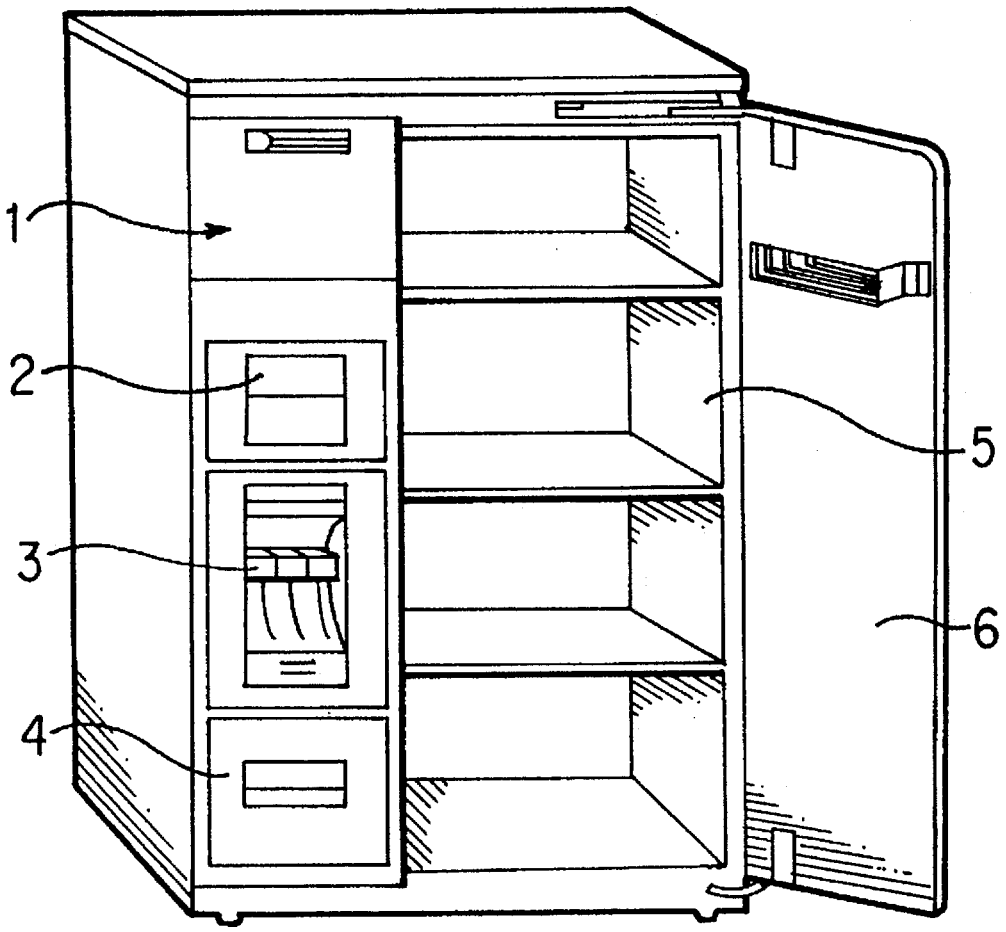
FIG. 1 PRIOR ART
FIG. 1 is a perspective view showing a rice barrel in accordance with an embodiment of convention art.
Figure 2:
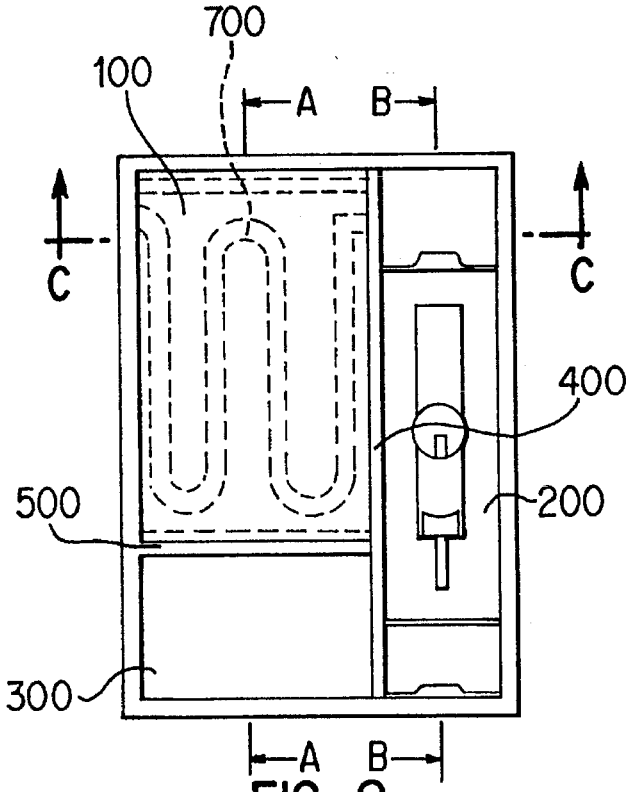
FIG. 2 is a front view showing a multifunction refrigerator in accordance with an embodiment of the present invention.

From FIG. 2 to FIG. 9, these drawings shows a multifunction refrigerator in accordance with the present invention.

The multifunction refrigerator comprises a cold storage room 100 for storing different kinds of foods, cereals storage room 200 for storing rice, miscellaneous cereals etc. and a kimchi storage room 300 for storing kimchi.

The cold storage room and the cereals custody room is divided by a first partition 400 having a good thermal conductivity, and the cold storage room and the kimchi storage room 300 is divided by a second partition 500.

Figure 4:
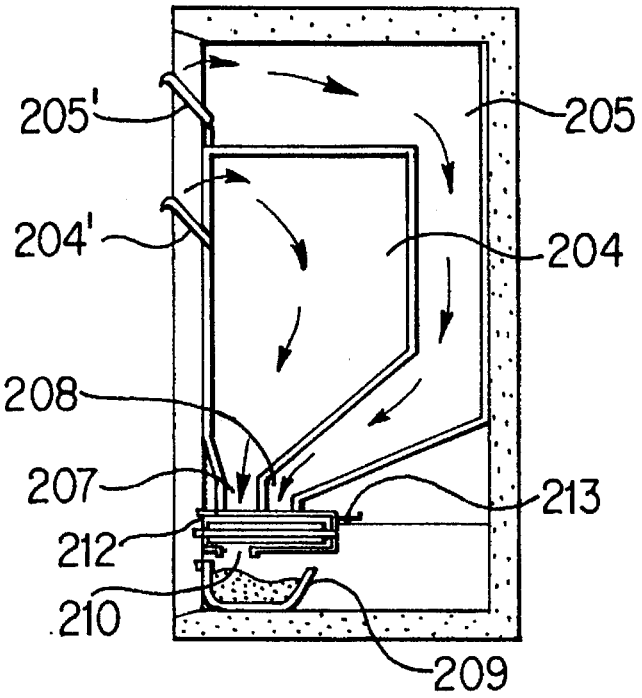
FIG. 4 is a sectional view taken along B—B of the multifunction refrigerator shown in FIG. 2.

As shown in FIG. 4, the cereals storage room 200 comprises a rice storage room 204 for storing rice flowed therein through a inflow hole 204', a miscellaneous cereals storage room 205 for storage miscellaneous cereals flowed therein through a inflow hole 205' and a container 209, wherein the miscellaneous cereals storage room 205 should be made vertically and parallel to withdraw rice with the rice storage room 204.

Figure 5:
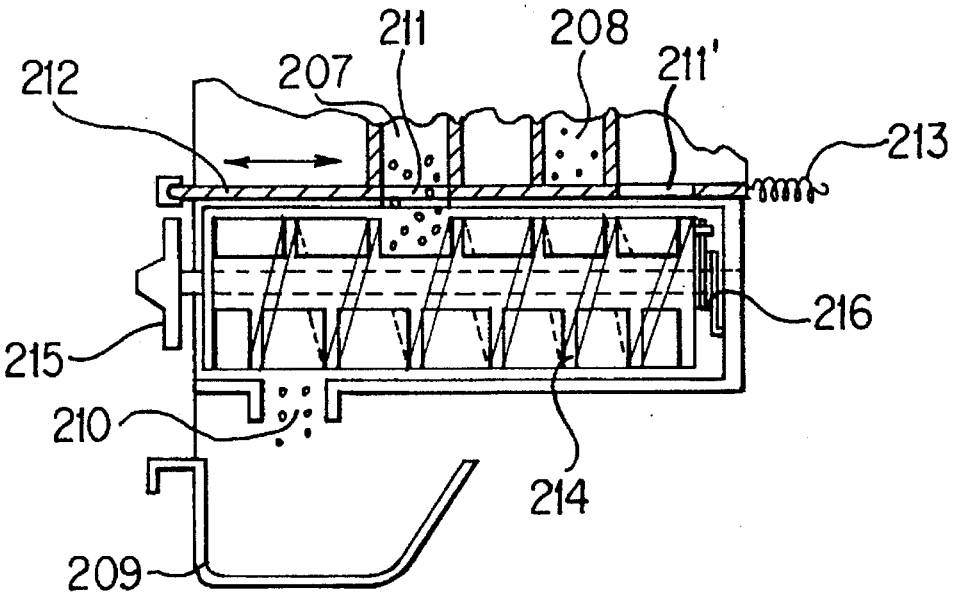
FIG. 5 is an enlarged sectional view of a withdrawal part shown in FIG. 4.

As shown in FIG. 5, so as to discharge rice and miscellaneous cereals in the rice storage room 204 and the miscellaneous cereals storage room 205, the cereals custody room 200 comprises a horizontal moving plate 212 for discharging selectively rice or miscellaneous cereals through rice outlet 207 of the rice storage room 204 or miscellaneous cereals outlet 208 of the miscellaneous cereals storage room 205, a first elastic member 213 for returning said horizontal moving plate 212 to its original location by pulling it, a moving screw 214 for moving rice or cereals to any location by its rotation, a second elastic member 216 being connected to one end of the moving screw 214, for rotating the screw 214 by elastic power and an outlet 210 making rice or cereals drop into the container 209.

Figure 8:
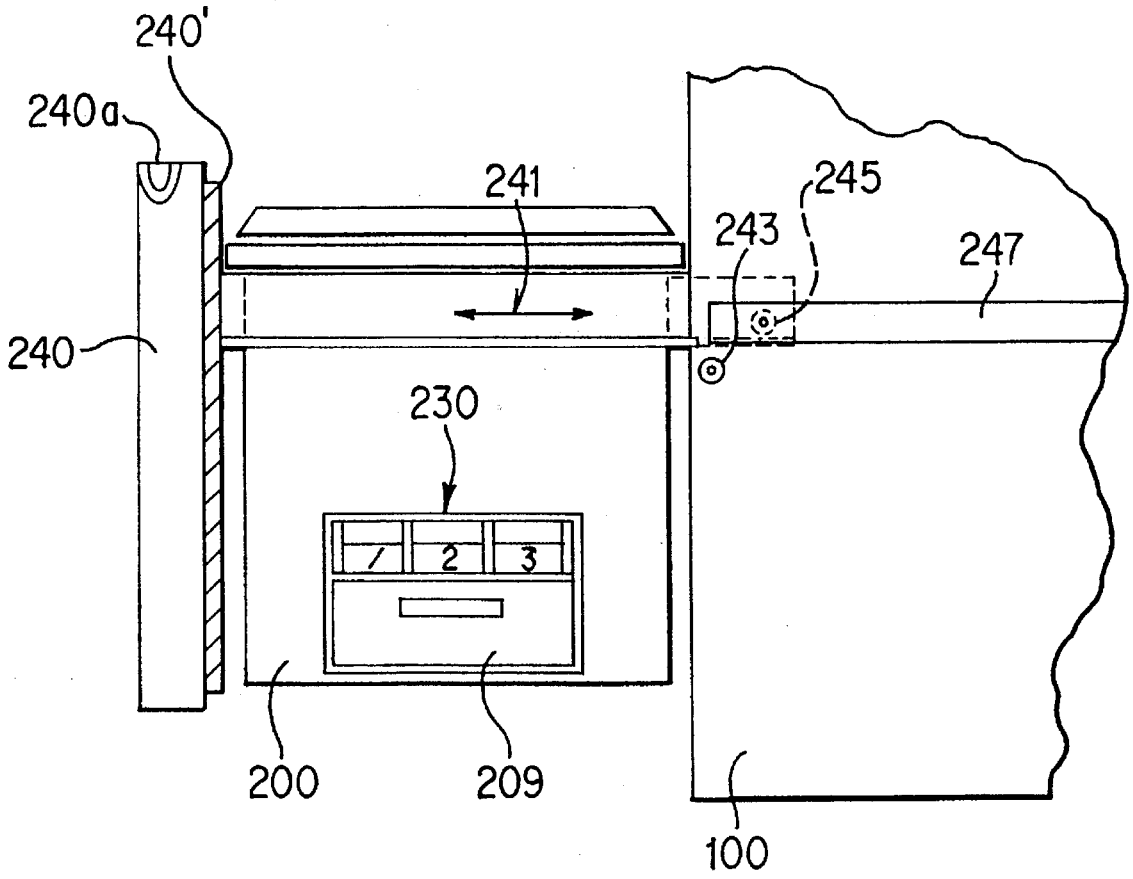
FIG. 8 is a side elevation of multifunction refrigerator in accordance with the present invention to show a state withdrawing cereals storage room from refrigerator.

Referring to FIG. 8, this is a side elevation of multifunction refrigerator showing cereals storage room 200 being withdrawn from it.

The withdrawn barrel or compartment comprises a guiding rail 241 formed on each side of the cereals storage room 200, guiding rollers 243, 245 for guiding the guiding rail 241 and a supporter 247 which two rollers are axially aligned.

Referring to FIG. 9, this is a partial sectional view of a humidity control part in accordance with the present invention.

As shown in the drawing, this humidity control part comprises a first evaporation part 920 and a second evaporation part 930.

The first evaporation part 920 comprises a water outlet pipe 910 through which a defrosted water generated from the evaporator 700 flows down, a first evaporation dish 921 in which the defrosted water flowing down through pipe 910 is collected, a permeating membrane for permeating the moisture being evaporated from said the first evaporation dish 921, and a inducing cover 925 for inducing the moisture passing the permeating membrane 923 into the cereals storage room 200 through holes 926 formed at its surface.

Further, the second evaporation part 930 comprises an outlet pipe 933 for discharging the defrosted water being oversupplied to the first evaporation part 920 and a second evaporation dish 931 for evaporating the water collected through the water outlet pipe 933.

Figure 6:
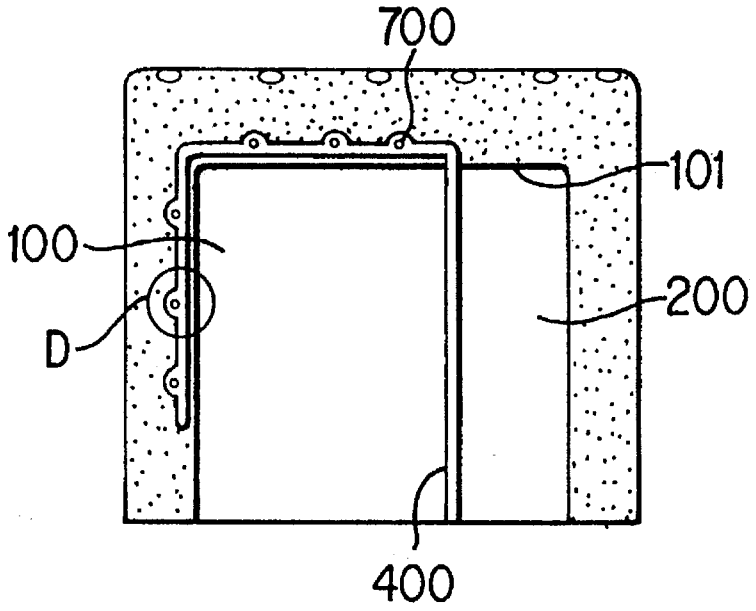
FIG. 6 is a sectional view taken along C—C of the multifunction refrigerator shown in FIG. 2.
Figure 7:
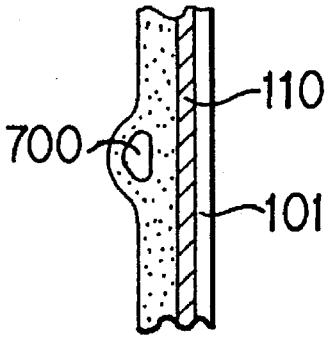
FIG. 7 is a enlarged view of D part shown in FIG. 6.

As shown in FIGS. 6 and 7, the evaporator 700 is established to be attached on the upper plate of the cold-storage room 100 by two-face tape 110.

The first partition 400 for separating the refrigerator into two parts of the cold storage room 100 and the cereals storage room 200, is connected to the evaporator 700 to transmit cool air generated from the evaporator 700 into the cold-storage room 100 and the cereals storage room 200.

Figure 3:
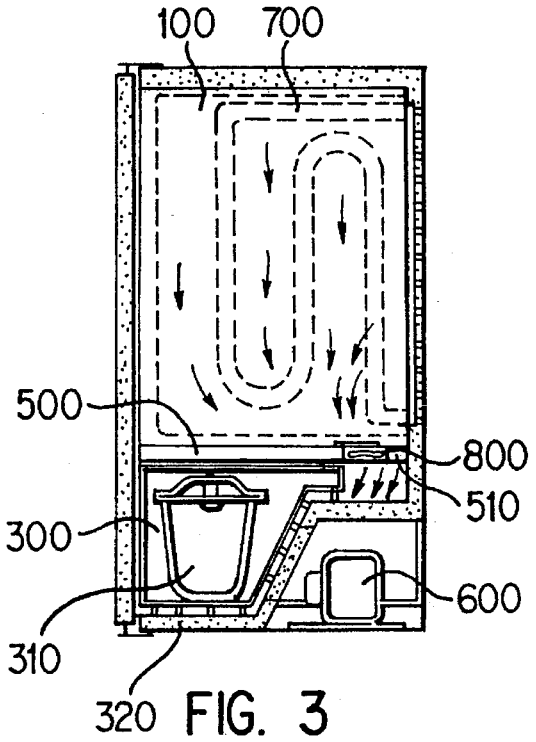
FIG. 3 is a sectional view taken along A—A of the multifunction refrigerator shown in FIG. 2.

As shown in FIG. 3, a heat generation member 320 is established at the lower portion of the kimchi storage room 300 to ferment kimchi during custody.

A transmitting hole is formed at any location of the second partition 500 for dividing the cool storage room 100 and kimchi storage room 300, to transmit cool air generated from the evaporator 700 into the kimchi storage room 300, and an inhalation fan 800 for inhaling cool air into the kimchi storage is established inside the transmitting hole 510.

Non descriptive symbols 600 and 310 are compressor and kimchi storage barrel, respectively.

At this state, when the compressor 600 is operated, since the cool air generated from the evaporator 700 of the cold storage room 100 attached on the upper plate, circulates into the cold storage room 100, the cereals storage room 200 and the kimchi storage room 300, the stored foods do not degenerate and can be stored for a long time.

Also, the cool air generated from the evaporator 700 attached on the upper plate 110 of the cold storage room, is conducted into the cereals custody room 200 by the first partition 400.

That is, since the first partition 400 is connected to the evaporator 700, the cool air generated from the evaporator 700, is conducted to the cereals custody room 200 along the first partition 400.

Accordingly, the cool air can prevent miscellaneous cereals in the miscellaneous custody room 205 and rice in the rice custody room 204 from being degenerated.

To withdraw cereals in the cold storage room 100, a user should pull a knob 240*a* formed at the door 240 of the cereals storage room 200. At this time, the cereals custody room 200 is drawn out along the supporter 247 positioned between two guiding rollers 241 and 243.

In a state that the cereals custody room 200 is drawn out, to withdraw cereals in it, a user should press a lever down in a quantity selecting part 230.

As a user presses the lever, a selected cereal drops into the container 209.

After a user has withdrawn a desired quantity of cereal, the user pushes it to return the withdrawn cereal storage room 200.

As the cereals storage room 200 gets inside the refrigerator, a gasket 240 positioned at the front side of the door 240 contacts a front portion of the refrigerator.

To store rice or cereals in the refrigerator, a user has to pour the rice or the cereals through each inflow hole 204' and 205'.

Hereinafter, a process for withdrawing stored rice or cereals will be described in detail.

As shown in FIG. 5, if a user wants to withdraw only rice, he should rotate the rotating lever 215, leaving the horizontal moving plate 212 in the original location. According to the rotation of the rotating lever 215, the rotating screw 214 concurrently moves the rice to outlet 210.

According to the rotation of the rotating screw 214, the dropped rice from rice storage room 204 through the rice outlet 207 and the rice dropping hole 211 is moved toward the outlet 210 and is dropped into the container 209.

After that, as the user releases the rotating lever 215, the rotating screw 214 comes back to its original location by the elastic power of the second elastic member 216.

On the other hand, to withdraw miscellaneous cereals, first, a user has to pull the horizontal moving plate 212.

In the state which the horizontal moving plate 212 is pulled out, the miscellaneous cereals in the miscellaneous storage room 205 drops down into the rotating screw 214 through a miscellaneous dropping hole 211' coincides with the miscellaneous outlet 208 by movement of the horizontal moving plate 212.

At this time, the user should rotate the rotating lever 215 to withdraw miscellaneous cereals. According to the rotation of the rotating lever 215, the rotating screw 214 does concurrently move such food to outlet 210. According to the rotating screw, the dropped miscellaneous cereal from the miscellaneous cereals storage room 205 through the miscellaneous cereals outlet 208 and the miscellaneous dropping hole 211' moves toward the outlet 210 and is dropped into the container 209.

After that, as the user releases the rotating lever 215 and the horizontal moving plate 212, the rotating screw 215 and the horizontal moving plate 212, the rotating screw 215 and the horizontal moving plate 212 comes back to the original state by elastic power of the second 216 and the first elastic 213 members.

When the evaporator 700 is operated, a frost is generated at its surface. A defrost water generated by elimination of the frost flows into the first evaporation dish 921 along the water outlet pipe 910 and evaporates at the first evaporation dish 921.

The vapor evaporated from the first evaporation dish 921 passes through the permeating membrane 923 and flows into the cereal storage room 200 through the holes 926, so that it controls the humidity of the cereals storage room 200. The size of the permeating membrane 923 is fabricated to maintain a humidity of 65%.

A defrost water oversupplied in the first evaporation dish 921 is flowed into the second evaporation dish 931 through the water outlet pipe 933 and is evaporated by the heat of condenser 935 again.

As described before, the multifunction refrigerator in accordance with the present invention can store foods, cereals and/or kimchi for a long time by supplying cool air generated from an evaporator into a cold storage room, a cereals custody room and a kimchi custody room.

In addition, since one refrigerator includes a cold storage room, cereals storage room and kimchi storage room, the present invention needs a small space therein and can serve a user's convenience.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A multifunction refrigerator comprising:

(a) a cold storage room;

(b) cereals storage room;

(c) a generating means for generating cool air from a wall face of the refrigerator; and (d) a conducting means for inducting the cool air generated from the generating means into the cold storage room and the cereals storage room;

wherein the cereals storage room comprises a rice storage room for storing rice, a discharging means for discharging the rice.

2. The refrigerator according to claim 1, wherein the generating means is an evaporator located on an upper plate of the cold storage room.

3. The refrigerator according to claim 2, wherein the conducting means includes a first partition for dividing the cold storage room and the cereals storage room and a second partition adjacent the first partition and connected to said evaporator for dividing the cold storage room from another storage room, having a good thermal conductivity, wherein the cool air generated from said evaporator is conducted into the cereals storage room through the first and second partition.

4. The refrigerator according to claim 3, wherein the conducting means includes a transmitting hole formed at a position of a second partition separating the refrigerator into two parts the cold storage room and a kimchi storage room, and an inhalation fan for inhaling cool air through the transmitting hole and transmitting the inhaled cool air into the kimchi storage room.

5. The refrigerator according to claim 1, wherein the discharging means comprises an outlet formed at the rice storage room and a miscellaneous cereal storage room respectively, a horizontal moving plate for dropping selectively the rice or the miscellaneous cereals being discharged from said outlet, a moving member for moving the rice or the miscellaneous cereals being dropped and a outlet for dropping the rice or the miscellaneous cereals moved from the moving member into a container.

6. The refrigerator according to claim 1, wherein the refrigerator includes a withdrawal means for withdrawing the cereal storage room from the refrigerator.

7. The refrigerator according to claim 6, wherein the withdrawal means comprises a guiding means comprising a guiding rollers formed at the cereals storage room and a supporter.

8. A multifunction refrigerator comprising:

a cold storage room;

a cereals storage room;

a generating means for generating cool air from a wall face of the refrigerator;

a conducting means for inducting the cool air generated from the generating means into the cold storage room and the cereals storage room;

wherein the cereals storage room comprises a rice storage room for storing rice, a discharging means for discharging the rice and a container for containing the rice being discharged from the discharging means;

wherein the refrigerator includes a humidity control part for maintaining constant humidity;

wherein the humidity control part comprises a water outlet pipe for removing atmospheric condensate from the generating means, a first means for evaporating which supplies the evaporated moisture into the cereals storage room when the water collected through the outlet pipe is evaporated, and a second means for evaporating which evaporates any condensate which exceeds the capacity of the first means for evaporating, the second means for evaporating discharging evaporated water outside of the refrigerator.

9. The refrigerator according to claim 8, wherein said the first evaporator part comprises a first evaporator dish for containing the defrosted water being collected along the water outlet pipe, a permeating membrane for permeating the moisture being evaporated from said the first evaporation dish and a cover for inducing the moisture passing the permeating membrane into the cereals custody room.

* * * * *